United States Patent [19]

Suzuki et al.

[11] Patent Number: 4,838,150

[45] Date of Patent: Jun. 13, 1989

[54] CLEAN ROOM

[75] Inventors: Yoshinobu Suzuki, Fujishiro; Mitsufusa Manabe, Yokohama, both of Japan

[73] Assignee: Shimizu Construction Co., Ltd., Japan

[21] Appl. No.: 57,525

[22] PCT Filed: Nov. 26, 1986

[86] PCT No.: PCT/JP86/00603

§ 371 Date: Apr. 21, 1987

§ 102(e) Date: Apr. 21, 1987

[87] PCT Pub. No.: WO87/03356

PCT Pub. Date: Jun. 4, 1987

[30] Foreign Application Priority Data

| | | | |
|---|---|---|---|
| Nov. 26, 1985 | [JP] | Japan | 60-265456 |
| Dec. 5, 1985 | [JP] | Japan | 60-274236 |
| Dec. 5, 1985 | [JP] | Japan | 60-274237 |
| Dec. 19, 1985 | [JP] | Japan | 60-286571 |
| Dec. 20, 1985 | [JP] | Japan | 60-287330 |
| Dec. 27, 1985 | [JP] | Japan | 60-294699 |

[51] Int. Cl.[4] ..... F24F 7/007

[52] U.S. Cl. ..... 98/31.5; 55/385 A; 55/385.2

[58] Field of Search ..... 55/385 A; 98/31.5, 31.6, 98/34.5, 34.6, 36, 115.3

[56] References Cited

U.S. PATENT DOCUMENTS 4,267,769 5/1981 Davis et al. ..... 98/31.5

FOREIGN PATENT DOCUMENTS

| | | | |
|---|---|---|---|
| 58-12703 | 3/1983 | Japan . | |
| 136930 | 8/1983 | Japan | 98/36 |
| 60-14454 | 2/1985 | Japan . | |
| 20030 | 2/1985 | Japan | 98/36 |
| 60-99943 | 6/1985 | Japan | 98/36 |
| 235625 | 10/1986 | Japan | 98/36 |

*Primary Examiner*—Harold Joyce

*Attorney, Agent, or Firm*—Kane, Dalsimer, Sullivan, Kurucz, Levy, Eisele and Richard

[57] ABSTRACT

A clean room suitable for use when ultra high cleanliness of air is to be maintained. The clean room has a ceiling (23), a floor (28), an indoor space (30) between the ceiling and the floor, an air supply means (24) for supplying the air of ultra high cleanliness to the indoor space, and an air exhausting means (40) for exhausting the air supplied to the indoor space. The indoor space is divided into a first region (B) requiring high cleanliness and a second region (A) adjacent to the first region and requiring ultra high cleanliness higher than that of the first region. The air supply means includes an air outlet port (26) arranged in a ceiling of the second region (A) and blowing the air downward, and the air exhausting means includes as first air inlet port (25) arranged in a ceiling of the first region and exhausting the air upward. Since part of the clean air blown off downward from the air outlet port is exhausted in the first inlet port, an air stream having a large transverse speed component flowing from the second region to the first region is generated, thereby preventing introduction of dust from the first region to the second region.

18 Claims, 7 Drawing Sheets

CLEAN ROOM

TECHNICAL FIELD

The present invention relates to a clean room used for maintaining ultra high cleanliness of a manufacturing environment in the field of manufacturing semiconductor, such as VLSIs and ICs.

BACKGROUND ART

Conventionally, a clean room of partial laminar flow type is known as a clean room in which ultra high cleanliness is maintained inside the room.

In the clean room of this type, outlet ports of air supply ducts are provided to almost the entire surface of the ceiling of the room. Air with ultra high cleanliness is blown off from these outlet ports into the room, flows downward toward the floor of the room in one direction in an almost laminar state, is exhausted into air inlet ports provided to almost the entire surface of the floor, and is circulated to the air outlet ports. Generally, the floor is a porous one made of a grating or a punching metal, and a number of pores of this porous floor serve as air inlet ports. In addition, the air outlet ports are provided with a high performance dust filter such as a ULPA filter.

Since the above conventional clean room blows off air from the entire surface of the ceiling, it requires a large absolute supply amount of air, resulting in increase in a running cost for a blower or the like, and hence in a high energy consumption type clean room. In addition, since the air blown off from the ceiling flows toward the floor only in one direction, dust generated in a passage or the like may be undesirably diffused by movement of a worker into a region requiring ultra high cleanliness, e.g., an installation region of a semiconductor manufacturing system in the clean room.

Accordingly, it is an object of the present invention to provide an energy-saving clean room.

It is another object of the present invention to provide a clean room wherein the amount of dust entering the installation region of the semiconductor manufacturing system is reduced to increase the yield of products.

It is still another object of the present invention to provide a clean room wherein vibrations of a floor of a passage are suppressed when a worker walks along the passage so that the vibrations are not easily transmitted to the semiconductor manufacturing system or the like.

It is still another object of the present invention to provide a clean room wherein maintenance of the semiconductor manufacturing system or the like installed inside the room or carrying in and out of a material with respect to the installation region can be easily performed.

DISCLOSURE OF INVENTION

In order to achieve the above objects, the present invention provides a clean room comprising a ceiling, a floor, an indoor space between the ceiling and the floor, an air supply means for supplying an air with ultra high cleanliness to the indoor space, and an air exhausting means for exhausting the air supplied to the indoor space. The indoor space is divided into a first region (e.g., a passage region) requiring high cleanliness and a second region (e.g., an installation region of a semiconductor system) adjacent to the first region and requiring ultra high cleanliness higher than that of the first region.

The air supply means includes an air outlet port, arranged on the ceiling of the second region, for blowing off the air downward, and the air exhausting means includes a first air inlet port, arranged on the ceiling of the first region, for exhausting the air upward. That is, with this arrangement, an air stream having a large speed component in a transverse direction is generated to flow from the second to first region to prevent introduction of dust from the first to second region. It is well known to provide an air inlet port to a ceiling of a passage region of a clean room of a type wherein the passage region and the system installation region are divided by a panel. However, no transverse air stream is generated in this arrangement because of the panel. In addition, a vortex is generated on the surface of the panel at the passage region so that cleanliness of the passage region tends to be degraded.

A clean room according to the present invention preferably has a straitening means for forming a smooth air stream flowing into the air inlet port. This straitening means may be a straitening plate disposed between the air outlet port and the air inlet port or be an auxiliary outlet port, disposed between the air outlet port and the air inlet port, for blowing an air obliquely toward the first region. With such a straitening means, no vortex is generated between the outlet and inlet ports so that the air inside the clean room is smoothly exhausted into the inlet port.

On the other hand, the floor of the first region is preferably a fixed floor so that vibrations of the floor produced when a worker walks thereon are suppressed. A fixed floor is a floor, i.e., a concrete floor, fixed to a column or a wall formed integrally with a basis of a building including the clean room. That is, by omitting the outlet port from the ceiling of the first region, the floor of the first region need not be a porous floor. In addition, if the floor of the second region is also a fixed floor, i.e., the entire floor of the clean room is a fixed floor, an underfloor free access floor required below the porous floor becomes unnecessary, so that the height of the clean room (a height from the floor to the ceiling) can be designed smaller. Furthermore, the floors of the first and second regions may be separated from each other so that vibrations produced at the first region are not so easily transferred to the second region. When the floors of the first and second regions are separated, a second air inlet port of the air exhausting means may be arranged between the floors of the first and second regions. The floors between the first and second regions may be connected with a porous floor.

Moreover, the clean room according to the present invention may comprise a partition member for partitioning the first and second regions. Note that the partition member has a ventilating means for flowing the air from the second region to the first region through the partition member. The partition member is preferably a partition plate or a partition sheet disposed between the first and second regions. The ventilating means is preferably a plurality of through holes substantially uniformly arranged on the entire surface of the partition plate or partition sheet. The partition plate may be movable side ways, and the partition sheet may be taken up sideways or vertically. Since the partition member is movable or capable of being taken up, carrying in and out of a material and the like with respect to the second region can be easily performed. In addition, an air passage may be provided to communicate the second region with the first air inlet port, and an upper edge of the partition plate may be arranged inside the air passage, so that dust at the upper edge of the partition member is forcibly exhausted to the inlet port.

BEST MODE OF CARRYING OUT THE INVENTION

Figure 1:
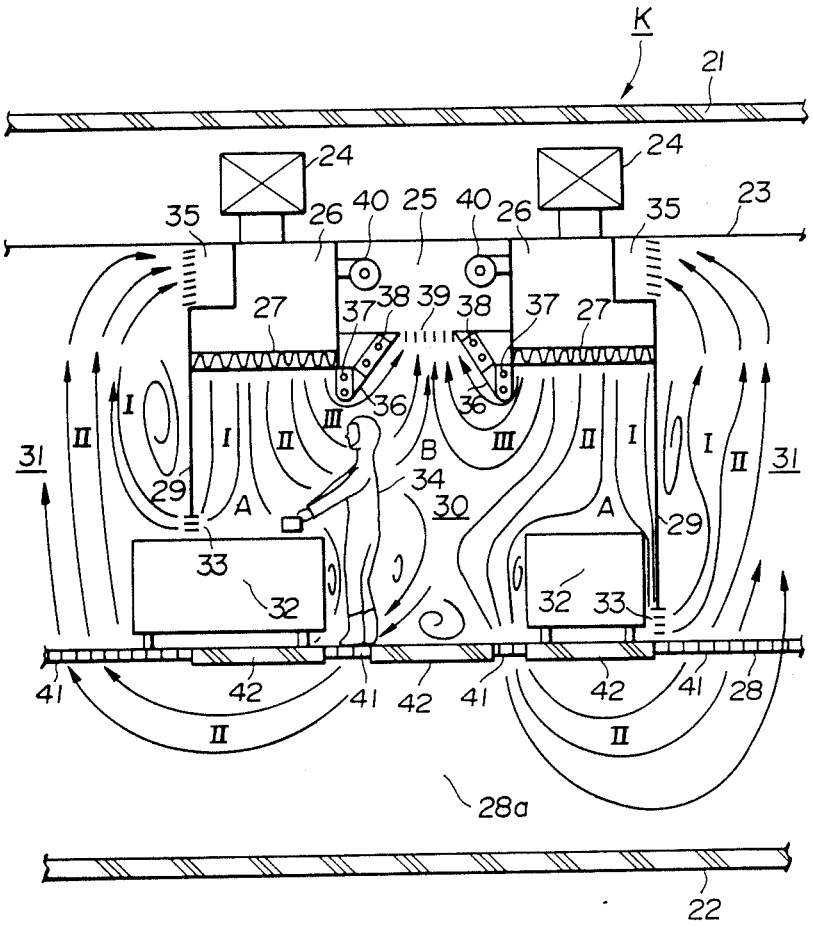
FIG. 1 is a schematic sectional view of a clean room according to the present invention.

In the drawings, the same parts are denoted by the same reference numerals, and a description thereof will be omitted.

FIG. 1 shows a clean room according to the present invention. In this clean room, a ceiling board 23 is arranged below an upper floor slab 21, and a floor board 28 is arranged above a lower floor slab 22. Air supply ducts (air supply means) 24 communicating with a main air conditioner (not shown) are disposed between the ceiling board 23 and the upper floor slab 21. An indoor space between the ceiling board 23 and the floor board 28 is divided by two partition plates (back panels) 29 into a central work room 30 and utility rooms 31 arranged at both sides of the work room 30. The work room 30 is divided into a first region B serving as a passage for workers and second regions A adjacent to both sides of the first region B and in each of which a manufacturing system 32 of LSIs or the like is installed. A first air inlet port 25 is provided below the ceiling board 23 and above the first region B, and air charging chambers 26 serving as air outlet ports are provided above the second regions A and at the both sides of the first region B. The air charging chambers 26 communicate with the air supply ducts 24 and with the underlying indoor space through ULPA filters (or HEPA filters) provided at lower portions of the air charging chambers 26.

On the other hand, portions of the floor board 28 which serve as a floor of the first region B and by which the manufacturing systems 32 are supported are concrete fixed floors 42. These fixed floors 42 of the first region B and the second region A are spaced apart from each other, and porous floors 41 of a grating or a punching metal are disposed in a spacing therebetween. Pores of the porous floors 41 serve as second inlet ports for exhausting the air and communicate with utility rooms 31 through a free access floor 28*a* between the floor board 28 and the lower floor slab 22. In addition, third air inlet ports 33 are formed at lower edges of the partition plates 29. When the manufacturing system 32 projects from the work room 30 to the utility room 31 because of its large length, a louver is provided to a portion of the partition plate 29 near an upper portion of the manufacturing system 32 to serve as a third air inlet port. When the manufacturing system 32 is housed inside the work room 30, a louver is provided to a portion of the partition plate 29 near the floor board 28 to serve as a third air inlet port.

Air conditioners 35 incorporating fans are provided to the air charging chambers 26 at the sides of the utility rooms 31, and straightening plates 36 are provided to the sides of the air charging chambers 26 and both lower sides of the first air inlet port 25 so that streams of air flowing from the air charging chambers 26 to the first air inlet port 25 are formed smoothly. Illuminators 37 for illuminating the second regions A and illuminators 38 for illuminating the first region B are disposed inside the straightening plates 36. In addition, a louver 39 is disposed between the straightening plates 36, and exhausting fans (air exhausting means) 40 are mounted to the sides of the air charging chambers 26 above the louver 39.

In the clean room having the above arrangement, air sent from the main air conditioner through the air supply ducts 24 is supplied to the right and left air charging chambers 26 provided to the ceiling. The air supplied to the air charging chambers 26 is cleaned through the ULPA filters 27 and then blown off into the work room 30. The clean air is returned to the air charging chambers 26 mainly through three kinds of passages.

A first passage I is a passage wherein the clean air blown off from the air charging chamber 26 strikes against the upper surface of the manufacturing system 32, reaches the utility room 31 through the third air inlet port 33, and then returned to the air charging chamber 26 through the air conditioner 35. A second passage II is a passage wherein the clean air blown off from the air charging chamber 26 strikes against the upper surface of the manufacturing system 32, reaches the utility room 31 through the second inlet port of the porous floor 41 and the underfloor free access floor 28*a* so as to surround the worker 34, and then returned to the air charging chamber 26 through the air conditioner 35. A third passage III is a passage wherein the clean air blown off from the air charging chamber 26 does not strike against the manufacturing system 32 but flows so as to surround the head or the like of the worker 34, reaches the first inlet port 25 through an upper portion of the first region B and the ceiling louver 39, and then returned to the air charging chamber 26 by the exhausting fan 40. Note that when a system (not shown) requiring exhausting of the air outside the room is installed in the clean room, the air flowing through either the passage I or II is exhausted into the system, passes therethrough, and then exhausted outside the building by an exhausting duct (not shown).

A region requiring the cleanest environment is the upper surface of each manufacturing system 32, i.e., the second region A including load and unload portions of a wafer cassette. Therefore, dust of the second region A must be directly removed by blowing the clean air, and introduction of dust from the first region B due to a vortex of the air must be prevented. Especially when the ceilings of the second and first regions are divided by illuminators or depending walls, a vortex tends to form above the worker. If dust produced by the worker enters the vortex, it requires a long time to remove the dust, and the dust tends to enter the second region along with movements or operation of the worker, so that generation of the vortex must be prevented.

In the above embodiment, in order to satisfy the above conditions, dust in the second region is removed by the clean air flowing through the passages I and II, and introduction of dust from the first region B is prevented by the clean air flowing through the passages II and III. Especially, the clean air flowing through the passages II and III is an air stream having a large transverse speed component directing from the second region A to the first region B, thereby almost completely preventing introduction of dust from the first region B. In addition, since the straitening plates 36 are provided to the first air inlet port 25, the line of the clean air flowing from the air charging chambers 26 to the first air inlet port 25 through the passage III can be smoothly formed. Therefore, no vortex is generated near the ceiling and no diffusion nor introduction of small particles in the air with respect to the second regions A occurs, so that the air is smoothly exhausted into the first inlet portion 25.

Cleanlinesses required for a super clean room represented by a partial laminar type clean room are class 10 (size of an objective particle=0.1 μm or more) for the second regions A and class 100 (size of an objective particle=0.1 μm or more) for the first region B. The cleanliness of the clean air flowing from the second region A is higher than that of the first region B, so that the first region B is cleaned by the clean air from the second region A.

Note that in the above embodiment, assume that an amount of the clean air supplied to the work room 30 is 10 $m^3$/min, a ratio of the amounts of the air exhausted from the passages I, II, and III is desirably such that passages I:II:III=1:4:5.

Accordingly, in this clean room, the second region A of the ultra high cleanliness is at a positive pressure while the first region B and the utility room 31 are kept at negative pressures, thereby obtaining a desired cleanliness for the second regions A and preventing the air from the first region B from mixing in to eliminate introduction of the dust and maintain the high cleanliness. In addition, since the air charging chambers 26 as the air outlet ports are provided only above the second regions A and the clean air is not blown off from the entire surface of the ceiling, the amount of air to be blown can be reduced (about 30% in this embodiment). Also, since the ULPA filters 27 need be provided only to the air charging chambers 26, an energy cost for driving the fan or the like and an installation cost can be reduced.

Moreover, since the work room 30 is not divided into the second regions A and the first region B by a screen or the like, movement of the worker 34 is not limited in the work room 30, and operability of the manufacturing system 32 can be improved, thereby allowing accurate, rapid, and fine operations.

Not the entire surface of the floor board 28 need be the porous floor 41 because the air supplied to the work room 30 can be exhausted through three kinds of passages, so that the fixed floor 42 may be provided immediately below the first region B and the manufacturing systems 32 by providing a slight space between the floors of the first and second regions. As a result, the worker 34 walks on the fixed floor 42 of the first region B so that no vibration is generated, and because the fixed floors 42 of the first region B and the manufacturing systems 32 are separated, vibrations can be prevented from being transferred to the manufacturing systems 32. In addition, the worker does not feel discomfort that he feels while walking on a grating floor.

Figure 2:
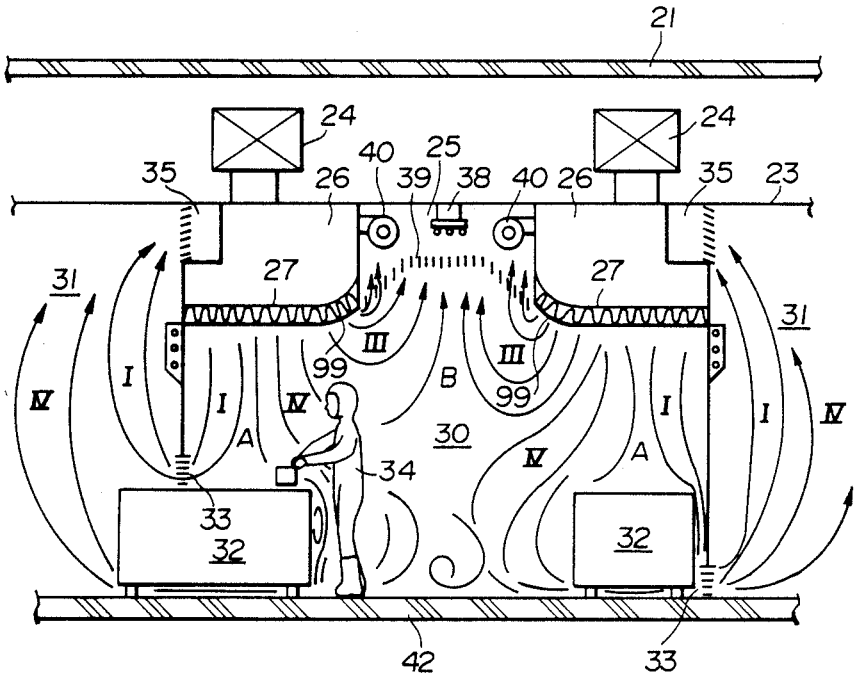
FIG. 2 is a schematic sectional view of another embodiment according to the present invention.

FIG. 2 shows another embodiment of the present invention. In FIG. 2, edges of the air charging chambers 26 at the side of the first inlet port 25 are bent toward the air inlet port 25 to form curved portions so that the clean air flows from the air charging chambers 26 to the first air inlet port 25 without generating any vortex. The ULPA filters 27 at the above portions are partially formed to be curved surfaces so as to correspond to the above curved portions. More specifically, these curved portions serve as an auxiliary outlet port 99 for blowing the air downward obliquely toward the first region B. In addition, the louver 39 of the first air outlet port 25 is arranged to have an inverted U shape so that its both sides smoothly continue to the curved surfaces of the edges of the air charging chambers 26.

On the other hand, in this embodiment, the porous floor 41 is omitted so that the entire floor board 28 consists of the fixed floor 42, and the underfloor access floor **28*a*** is also omitted.

With this arrangement, of the clean air blown from the air charging chambers 26, the air to flow through the passage I is blown vertically toward the manufacturing systems 32. As for the air to flow through the passage III, part of the air stream near the first air inlet port 25 is exhausted transversely and short-circuits toward the first air inlet port 25 and blown obliquely to surround the head of the worker 34 as it flows away from the first air inlet port 25.

Similar to the air flowing through the passage III, the clean air flowing through the passage IV is an air stream having a large transverse speed component directed from the second regions A to the first region B. Therefore, the air flowing through the passage IV completely prevents introduction of the dust from the first region B, reaches the utility rooms 31 through below the manufacturing systems 32, and then returns to the air charging chambers 26 through the air conditioners 35.

Since the illuminator 38 for illuminating the first region B is disposed to the ceiling board 23 inside the air inlet port 25, and the illuminators 37 for illuminating the second regions A are disposed to the upper back surfaces of the partition plates 29, required brightness can be obtained without disturbing the air streams inside the work room 30. Moreover, since the louver 39 of the first air inlet port 25 is an exhausting port with a transparent damper to obtain a function as a louver, the first region B can be illuminated uniformly and brightly.

Furthermore, according to the present invention, devices, pipes, or ducts provided to the manufacturing systems 32 can be arranged on the same floor as that of the manufacturing systems so as to improve workability and reduce a construction cost for the floors.

Note that in this embodiment, the auxiliary outlet port 99 is part of the air outlet port 26, but an auxiliary outlet port independent of the air outlet port 26 may be provided.

Figure 3:
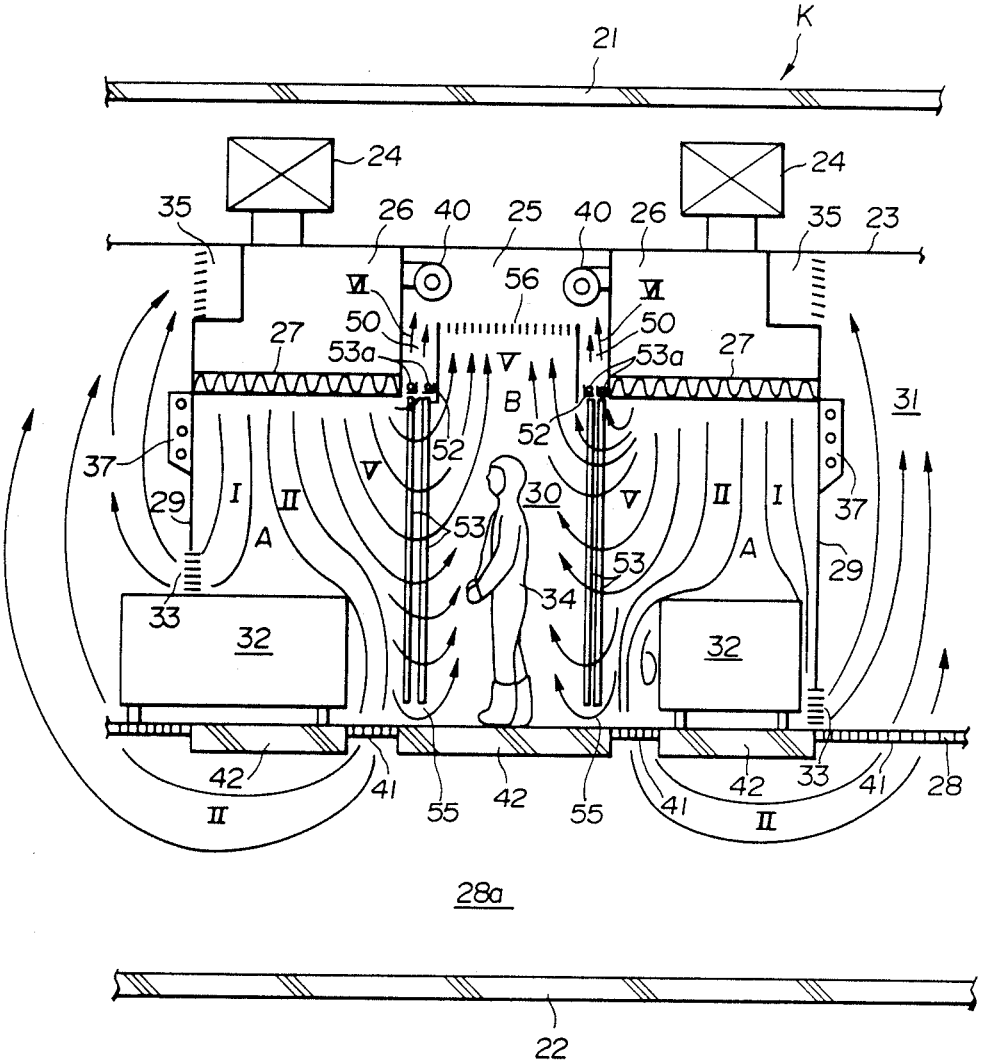
FIG. 3 is a schematic sectional view of still another embodiment according to the present invention.
Figure 4:
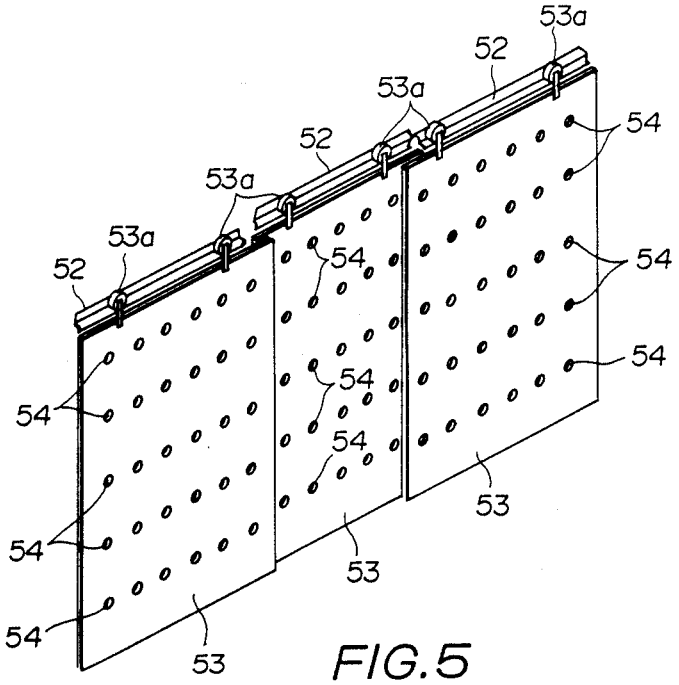
FIG. 4 is a perspective view of a partition plate shown in FIG. 3.
Figure 5:
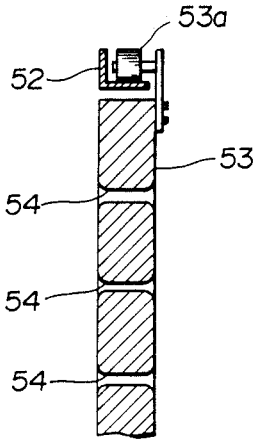
FIG. 5 is an enlarged sectional view of an upper portion of the partition plate shown in FIG. 4.

FIGS. 3 to 5 show still another embodiment of the present invention. In FIGS. 3 to 5, air passages 50 for communicating the second regions A with the first region B are provided to the both lower sides of the first inlet port 25 and the sides of the air charging chambers 26. Two rails 52 are disposed in the air passages 50 to suspend a plurality of partition plates 53 for partitioning the first and second regions B and A. As shown in FIGS. 4 and 5, each partition plate 53 is obtained by forming almost uniformly a plurality of ventilation holes 54 throughout a transparent rectangular plate, and wheels 53*a* are mounted to upper portions of the partition plate 53 so that the partition plate 53 moves along the rails 52. In addition, the size of the partition plate 53 is determined such that a predetermine space is formed between its lower end and the floor board 28, and the space serves as a breather 55 for flowing the air from inside the second regions A to the first region B. As shown in FIG. 5, each of the ventilation holes 54 formed in the partition plate 53 is a bell-shaped opening both sides of which gradually expand to form a curved line and continue to the surface of the partition plate 53 so as to reduce the resistance of the air flowing through it and to prevent generation of a vortex around the hole. That is, by changing the inner diameter and the number of the ventilation holes 54, the amount of the air flowing into the first region B can be controlled. In addition, an operation hole or a work window (not shown) is provided to a predetermined portion of each partition plate 53 so that the worker can operate the corresponding manufacturing system 32. As shown in FIG. 3, a louver 56 with a damper is provided near the lower portion of the first inlet port 25 and between the air charging chambers 26.

In the clean room with the above arrangement, the clean air blown off from the air outlet port 26 is circulated to the air outlet port 26 through two passages V and VI in addition to two passages I and II. The third passage V is a passage wherein the clean air flows through the ventilation holes 54 of the partition plate 53 and then the underlying breather 55 to the first region B without blowing against the manufacturing system 32, rises and reaches the first inlet port 25 through the ceiling louver 56 provided above the first region B, and then circulated to the air charging chamber 26 by an exhausting fan 40. The fourth passage VI is a passage wherein the clean air flows directly to the first inlet port 25 through the air passage 50, and then circulated to the air charging chamber 26 by the exhausting fan 40.

The air flowing through the above passage V flows uniformly into the first region B from the entire surfaces of the partition plates 53 through a number of ventilation holes 54 formed in the partition plates 53, so that a vortex is not easily generated on the surfaces of the partition plates 53 at the side of the first region B. By changing the number and the inner diameter of the ventilation holes 54 of each partition plate 53, the amount of the air flowing from the surface of the partition plate 53 can be controlled, and the amount of the air from the breather 55 below the partition plate 53 can also be controlled. Therefore, by accurately controlling the amount of the air from the breather 55, disturbance of dust deposited on the floor board 28 due to an air stream flowing therethrough can be reliably controlled.

The air flowing through the above passage VI removes dust floating near the upper end portion of the partition plate 53 to the first inlet port 25 during its passage through the air passage 50.

In the clean room with the above arrangement, since each second region A is surrounded by a back panel 29 and the partition plates 53, the second region A of the ultra high cleanliness is set at a positive pressure while the first region B of the high cleanliness and the utility room 31 is set at a negative pressure, so that a predetermined cleanliness is obtained for the second region A only by supplying a small amount of clean air (a flow rate of the clean air in the second region A can be set to 0.2 m/s or less). In addition, diffusion and introduction of dust from the first region B can be completely prevented to maintain the stable ultra high cleanliness.

The partition plates 53 can be moved in the right and left directions along the rails 52 to facilitate maintenance of the manufacturing systems 32 and carrying in and out of the material with respect to the second region A. Moreover, since the upper end portion of each partition plate 53 is arranged inside the air passage 50, dust does not float near this upper end portion.

Furthermore, since the air supplied to each second region A can be exhausted through the four passages, not all the floor board 28 need be a porous floor 41, and a fixed floor 42 can be provided immediately below the first region B and the manufacturing systems 32 only by providing a slight space immediately below near the boundary of the second and first regions A and B.

Figure 6:
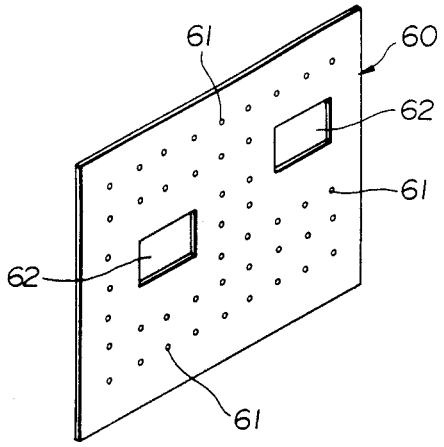
FIG. 6 is a perspective view of a modification of the partition plate shown in FIG. 4.

FIG. 6 shows a modification of the partition plate of FIG. 4. This partition plate 60 has a number of ventilation holes 61 in its entire surface and operation holes 62 at positions corresponding to respective load positions of the manufacturing systems 32 and having a size enabling passing of a cassette or the like for housing a semiconductor.

Figure 7:
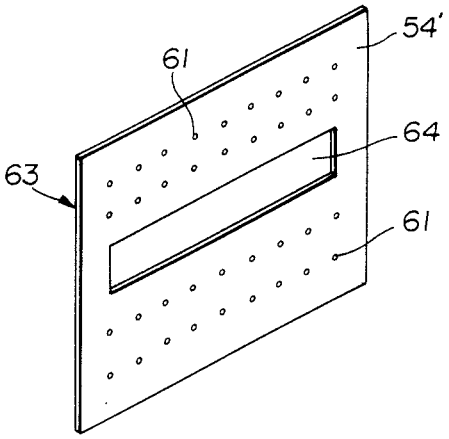
FIG. 7 is a perspective view of another modification of the partition plate shown in FIG. 4.

FIG. 7 shows another modification of the partition plate of FIG. 4. This partition plate 63 has a horizontal slit-like operation hole 64. The partition plate 63 having the operation hole 64 of such a shape is applied to a manufacturing system wherein all the load positions are aligned at the same height. The ventilation hole need not be a circle hole but may be a slit-like hole like the operation hole 64.

Figure 8:
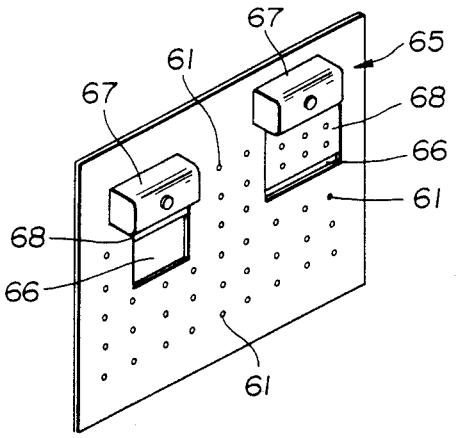
FIG. 8 is a perspective view of still another modification of the partition plate shown in FIG. 4.

FIG. 8 shows still another embodiment of the partition plate of FIG. 4. This partition plate 64 has operation holes 66 each having the same shape as that of the operation hole 62 of the partition plate 60 shown in FIG. 6. Shutter mechanisms 67 projecting toward the first region B and for opening and closing the operation holes 66 are provided to their upper edges, to open or close them by screens 68.

Figure 9:
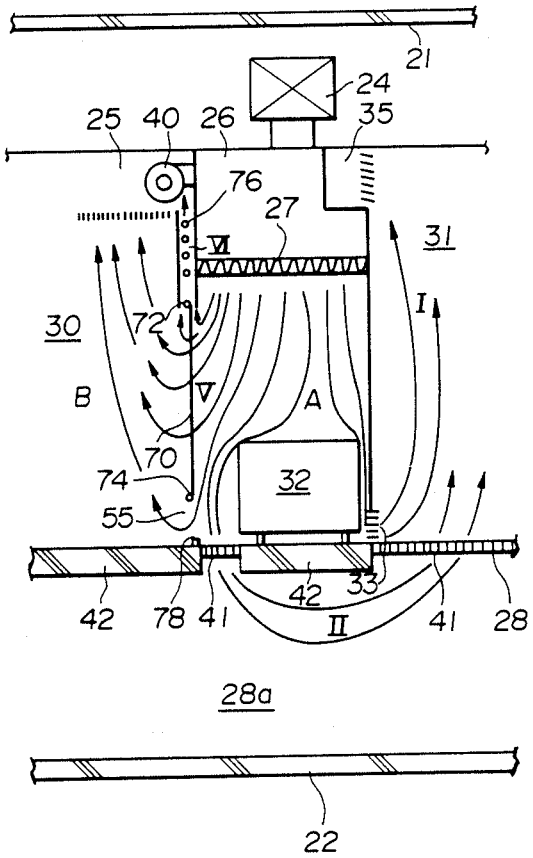
FIG. 9 is a schematic sectional view of still another embodiment according to the present invention.

FIG. 9 shows still another embodiment of the present invention. In FIG. 9, reference numberal 70 denotes a partition sheet provided between the second and first regions A and B. A number of fine ventilation holes (not shown) are formed in the entire surface of the partition sheet 70, and the partition sheet 70 is vertically movable by a take-up bar 72 with a rotation mechanism provided to the upper end portion of the partition sheet 70. The take-up bar 72, i.e., the upper end portion of the partition sheet 70 is arranged inside the air passage 50. A weight 74 for preventing loosening or pivoting of the partition sheet 70 is mounted to the lower end portion thereof, and a space 55 is formed between the lower portion of the weight 74 and the floor board 28. An operation hole (not shown) is provided to the partition sheet 70 so that the worker 34 operates the manufacturing system, and an illuminator 76 is mounted inside the air passage 50. Note that a foot switch 78 for automatically controlling the rotation mechanism at the upper portion of the partition sheet 70 to vertically open and close the partition sheet 70 may be provided to the floor board 28.

In such a clean room, the air flowing through the passage V uniformly flows into the first region B through the entire surface of the partition sheet 70 via the ventilation holes formed therein, so that a vortex does not occur near the surface of the partition sheet 70 at the side of the first region B. By changing the diameter or the number of the ventilation holes formed in the partition sheet 70, the amount or flow rate of the air exhausted from the ventilation holes 55 can be controlled. In addition, the air flowing through the passage VI removes dust floating near the illuminator 76 or the upper end portion of the partition sheet 70 to the first inlet port 25 during its passage through the air passage 50.

Furthermore, the partition sheet 70 can be easily installed, and its opening and closing operation can be easily performed.

Figure 10:
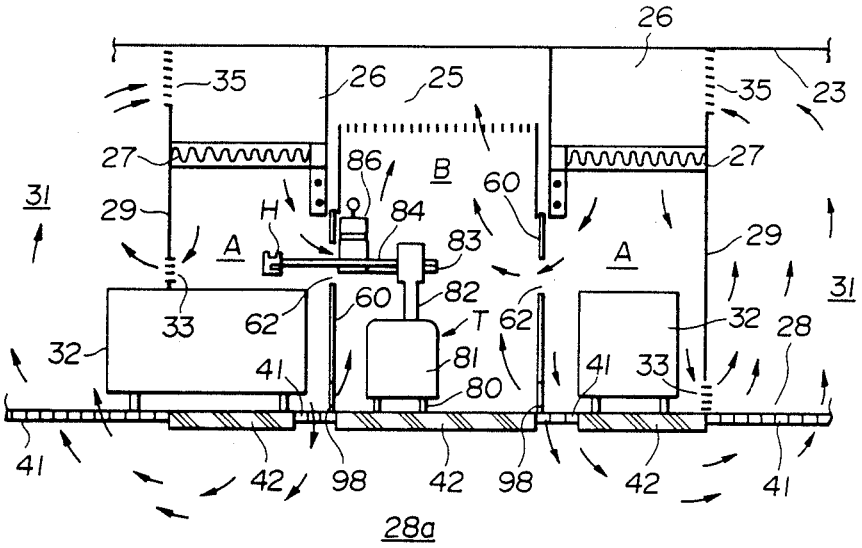
FIG. 10 is a schematic sectional view of a clean room having a carrier system for a workpiece.
Figure 11:
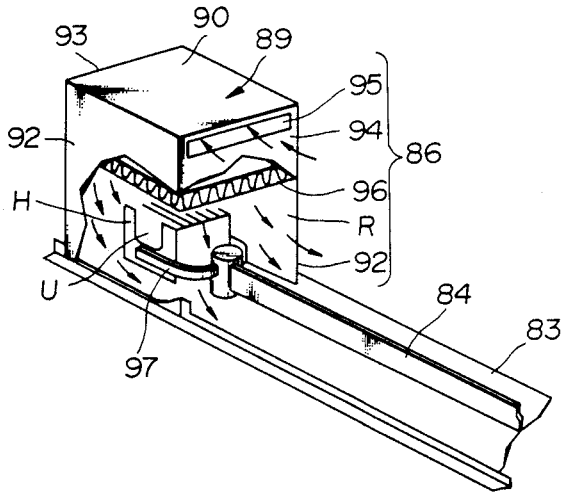
FIG. 11 is a perspective view of an essential part of the carrier system shown in FIG. 10.

FIGS. 10 and 11 show a carrier system T used in the clean room as shown in the above embodiments. The carrier system T is a system for carrying a material to be manufactured such as a semiconductor wafer. The carrier system T mainly includes a truck 81 comprising wheels 80, a drive mechanism, and a battery and capable of running by itself, a plate-like supporting base 83 mounted horizontally to a post 82 extending vertically on the upper portion of the truck 81, a grip arm 84 movable horizontally along the upper surface of the supporting base 83, and an air cleaner 86 provided on the upper surface of the distal end portion of the supporting base 83.

A sensor for detecting a reflective guide tape (guide member) such as an aluminum tape adhered to the lower floor of the truck 81 of the above carrier system T is provided to the truck 81, so that the truck 81 runs along the reflective guide tape detected by the sensor.

As shown in FIG. 11, the above air cleaner 86 includes a housing 89 having a dust filter 96 and a blower. The housing 89 is a box with an open bottom including a ceiling board 90, both side boards 42, and an upper front board 93 and an upper back board 94 connecting the upper halves of the both side boards 92. Openings below the upper front and back boards 93 and 94 are doorways R. The housing 89 is provided to the distal end of the supporting base 83 such that the upper front board 93 faces the front distal end of the supporting base 83, and a wafer case H housing a number of wafers (materials to be manufactured) is placed on the upper surface of the supporting base 83 below the housing 89. The blower (not shown) for taking in the air from an inlet hole 95 formed in the upper back board 94 and blowing it downward is housed in the housing 89, and the dust filter 96 such as a ULPA filter is provided below the blower, thereby blowing the clean air downward and toward the housing 89. Note that the blower in the housing 89 has a battery as a power source provided in the truck 81, and blows the air backward and downward in the housing 89 as indicated by an arrow in FIG. 11, so that the clean air flows inside the housing 89 and blown off from the doorway R below the upper back board 94.

The above grip arm 84 can be moved horizontally by the drive mechanism provided to the post 82, and a grip hand 97 capable of moving between the both side boards 92 by movement of the grip arm 84 to grip the wafer case H is provided to the distal end of the grip arm 84. Note that the grip arm 84 expands or contracts so that the grip hand 97 moves through and before the housing 89.

When a wafer U is to be carried from a storage portion of wafers such as a stocker to a manufacturing system 32 using the carrier system T with above arrangement, a host computer on-line connected to the manufacturing system 32 outputs an instruction to carry the wafer U from the storage portion of wafers to the manufacturing system 32. The carrier system T starts operation in accordance with the instruction. The carrier system T places the wafer cassette H taken out from the wafer storage portion by the grip arm 84 on the distal end of the supporting base below the housing 89, and moves from the wafer storage portion to the manufacturing system 32 along the reflective tape adhered to the floor board 28 of the first region B. At this time, the blower inside the housing 89 blows clean air to the wafer U to surround it with the clean air. With this effect, even when the carrier system T moves in the first region B with low cleanliness, no dust is adhered to the wafer U. For this reason, when the first region B is under the cleanliness condition below class 1,000, the wafer U can be carried without contamination. Note that in the housing 89, since the clean air flows from the upper front board 93 to the upper back board 94 as shown in FIG. 11, the side boards 92 or the upper back board 94 must face the running direction when the carrier system T is to run. This is because if the carrier system T runs with the upper front board 93 facing the running direction, the air in the first region B of the low cleanliness is introduced into the housing 89. In addition, since the floor of the first region B is the fixed floor 42 and the fixed floors 42 on which the manufacturing systems 32 are installed are separated by the porous floors 41, vibrations generated by the carrier system T are prevented from being transmitted to the manufacturing systems 32.

The carrier system T moving in front of the manufacturing system 32 stops at a position shown in FIG. 10 in front of the partition plate 60 before the manufacturing system 32 and then directs the upper front board 94 toward the operation holes 62 of the partition plate 60. Then, the carrier system T removes the wafer cassette H gripped by the grip hand 97 of the extended grip arm 84, moves it toward the manufacturing system 32 before the carrier system T through the operation hole 62 of the partition plate 60, and then sets it at the load position of the manufacturing system 32. At this time, around the partition plate 60, the clean air inside the second region A moves toward the first region B through the operation hole 62, and inside the housing 89, the clean air moves from below the upper front board 93 toward the back side of the housing 89. Therefore, both of the clean air streams flow in the same direction and merge into a single stream without generating turbulence. For this reason, introduction of dust into the housing 89 can be prevented when the housing 89 passes through the partition plate 60. At this time, if the upper back board 94 faces the partition plate 60, the clean air inside the housing 89 and that flowing through the operation hole 62 flow against each other to generate turbulence, and the air in the first region B around the partition plate 60 may undesirably flow into the housing 89.

The operation hole 62 of the partition plate 60 may be aligned with the housing 89 by an oscillator of an infrared beam or a laser beam mounted at the periphery of the operation hole 62 and a light-receiving element mounted to a predetermined position, or by a video camera provided to the housing and for performing image processing to recognize a position. Note that when the wafer cassette H is taken out from a manufacturing system 32, the grip arm 84 may be extended so that the grip hand 97 reaches the wafer cassette H of the manufacturing system and grips the wafer cassette H, and then the grip arm 84 may be moved backward to place the wafer cassette H on the supporting base 33.

Note that the partition plate 60 is suspended from the bottom portion of the air charging chamber 26 to be movable along the longitudinal direction of the second region A (the vertical direction with respect to the sheet of FIG. 10), and that the bottom portion of the partition plate 60 is placed on a rail 98 disposed on the floor board 28 so that the partition plate 60 does not vibrate due to changes in pressure of the second and first regions A and B.

As is described above, if the wafer U is carried by the carrier system T, it can be carried from the wafer storage portion to the load position of the manufacturing system 32 through the first region B without being contaminated. In addition, since the wafer U can be carried without contamination under the cleanliness condition below class 1,000, the carrier system T may be used in not only a manufacturing process but also between processes of a lower cleanliness.

Furthermore, a moving passage of the carrier system T can be easily changed by changing the position of the reflecting tape or the like adhered to the floor board 28. Therefore, if the manufacturing system or the manufacturing process are changed, the carrier system T can easily correspond to such a change at low cost, and hence is a very flexible system. In addition, the carrier system T can take out the wafer U from the storage portion, move along the clean room, and set the wafer U at the load position of the manufacturing system 32, thereby reducing an installation cost as compared with a conventional system requiring a robot or the like for moving a grip in addition to a carrier system.

INDUSTRIAL APPLICABILITY

The clean room according to the present invention is extremely effective when used in the field of manufacturing semiconductors such as VLSIs, ICs, or the like to maintain an ultra high cleanliness of the manufacturing environment.

We claim:

1. A clean room comprising a ceiling, a floor, an indoor space between the ceiling and the floor, air supply means for supplying an air of ultra high cleanliness to the indoor space, and air exhausting means for exhausting the air supplied to the indoor space, said indoor space being divided into a first region requiring high cleanliness and a second region adjacent to the first region and requiring ultra high cleanliness higher than that of the first region, characterized in that said air supply means includes an air outlet port arranged in a ceiling of said second region and blowing the air downward, said air exhausting means includes a first air inlet port arranged in a ceiling of said first region and exhausting the air upward, thereby generating a transverse air stream flowing from said second region to said first region, said first region of the indoor space serves as a passage for workers and includes a fixed floor, said second region of the indoor space is a region for installing a precision manufacturing system and includes a fixed floor, and the respective fixed floors of said first and second regions are spaced apart from each other so that vibration generated in the fixed floor of the first region due to the movement of a worker, is prevented from being transferred to the fixed floor of the second region.

2. A clean room according to claim 1, characterized by further comprising straightening means for smoothly forming a line of the air stream flowing into said air inlet port.

3. A clean room according to claim 2, characterized in that said straightening means is a straightening plate extending obliquely relative to a horizontal plane, between said air outlet port and said air inlet port.

4. A clean room according to claim 2, characterized in that said straightening means is an auxiliary outlet disposed between said air outlet port and said air inlet port and blowing the air obliquely downward toward said first region.

5. A clean room according to claim 1, characterized in that said air exhausting means has a second air inlet port between the floor of said first region and the floor of said second region.

6. A clean room according to claim 5, characterized by further comprising a porous floor disposed between the floor of said first region and the floor of said second region, said porous floor having a number of through holes.

7. A clean room comprising a ceiling, a floor, and indoor space defined by the ceiling and the floor, air supply means for supplying an air of ultra high cleanliness to the indoor space, air exhausting means for exhausting the air supplied to the indoor space, and a partition member for partitioning said indoor space into a first region and a second region, the first region requiring high cleanliness, the second region being adjacent to the first region and requiring ultra high cleanliness higher than of the first region, said partition member having ventilating means for allowing air to flow from said second region to said first region therethrough, said air supply means including an air outlet port arranged in a ceiling of said second region, the air outlet port blowing the air downward, said air exhausting means including a first air inlet port arranged in a ceiling of said first region, the air inlet port exhausting the air upward, whereby generated is a transverse air stream flowing from said second region to said first region.

8. A clean room according to claim 7, characterized in that said partition member is a partition plate disposed between said first region and said second region and said ventilating means is a plurality of ventilation holes disposed almost uniformly on an entire surface of said partition plate.

9. A clean room according to claim 8, characterized in that said partition plate can be moved almost horizontally to facilitate carrying in and out of a material with respect to said second region.

10. A clean room accordinag to claim 9, characterized by further comprising an air passage for communicatively connecting said second region with said first air inlet port, and guide rail substantially horizontally disposed in the air passage, said partition plate having an upper edge movably connected to the guide rail for horizontal movement of the partition plate, the upper edge of said partition plate being arranged in said air passage.

11. A clean room according to claim 7, characterized in that said partition member is a partition sheet disposed between said first region and said second region and said ventilating means is a plurality of ventilation holes arranged almost uniformly on an entire surface of said partition sheet.

12. A clean room according to claim 11, characterized in that said partition sheet can be taken up to facilitate carrying in and out of a material with respect to said second region.

13. A clean room according to claim 12, characterized by further comprising an air passage for communicatively connecting said second region with said first air inlet port, and rotation means for vertically moving the partition sheet, the rotation means being arranged in said air passage.

14. A clean room according to claim 7, further comprising straightening means for smoothly forming a line of an air stream flowing into said air inlet port.

15. A clean room according to claim 14, wherein said straightening means is a straightening plate extending obliquely relative to a horizontal plane, between the air outlet port and the air inlet port.

16. A clean room according to claim 14, wherein said straightening means is an auxiliary outlet disposed between the air outlet port and the air inlet port, the auxiliary outlet blowing the air obliquely downwardy toward said first region.

17. A clean room comprising: a ceiling; a floor; an indoor space defined by the ceiling and the floor; air supply means for supplying an air of ultra high cleanliness to the indoor space; air exhausting means for exhausting the air supplied to the indoor space; and straightening means for smoothly forming a line of an air stream flowing into the air exhausting means, said indoor space being divided into a first region requiring high cleanliness and a second region adjacent to the first region and requiring ultra high cleanliness higher than that of the first region, said air supply means comprising an air outlet port arranged in a ceiling of said second region, the air outlet port blowing the air downward, said air exhausting means comprising a first air inlet port arranged in a ceiling of said first region, the first air inlet port exhausting the air upward, thereby generating a transverse air stream flowing from said second region to said straightening means comprising a straightening plate extending obliquely relative to a horizontal plane, between said air outlet port and said inlet port.

18. A clean room comprising: a ceiling; a floor; an indoor space defined by the ceiling and the floor; air supply means for supplying an air of ultra high cleanliness to the indoor space, air exhausting means for exhausting the air supplied to the indoor space; and straightening means for smoothly forming a line of an air stream flowing into the air exhausting means, said indoor space being divided into a first region requiring high cleanliness and a second region adjacent to the first region and requiring ultra high cleanliness higher than that of the first region, said air supply means comprising an air outlet port arranged in a ceiling of said second region, the air outlet port blowing the air downward, said air exhausting means comprising a first air inlet port arranged in a ceiling of said first region, the first air inlet port exhausting the air upward, thereby generating a transverse air stream flowing said second region to said first region, said straightening means comprising an auxiliary outlet disposed between said air outlet port and said air inlet port, the auxiliary outlet blowing the air obliquely downwardly toward said first region.

* * * * *

UNITED STATES PATENT AND TRADEMARK OFFICE

CERTIFICATE OF CORRECTION

PATENT NO. : 4,838,150

DATED : June 13, 1989

INVENTOR(S) : Yoshinobu Suzuki, et al

It is certified that error appears in the above-identified patent and that said Letters Patent is hereby corrected as shown below:

Title page, item [30], Foreign Application Priority Data:

reads: "Nov. 26, 1985 [JP] Japan 60-265456"

should read: --Nov. 26, 1985 [JP] Japan 60-265465--

Signed and Sealed this

Twelfth Day of October, 1993

Bruce Lehman

*Attest:*

BRUCE LEHMAN

*Attesting Officer*

*Commissioner of Patents and Trademarks*